US006754921B2

(12) United States Patent
Gill-Barajas

(10) Patent No.: US 6,754,921 B2
(45) Date of Patent: Jun. 29, 2004

(54) SAFETY PILLOW TO PREVENT A PERSON FROM FALLING OFF A BED

(76) Inventor: Jeanne Lynn Gill-Barajas, 1037 Arcadia Ave. "C", Arcadia, CA (US) 91007

( * ) Notice: Subject to any disclaimer, the term of this patent is extended or adjusted under 35 U.S.C. 154(b) by 0 days.

(21) Appl. No.: 09/858,214

(22) Filed: May 15, 2001

(65) Prior Publication Data

US 2004/0003469 A1 Jan. 8, 2004

(51) Int. Cl.[7] ..... A47C 21/08

(52) U.S. Cl. ..... 5/425; 5/426; 5/428; 5/632; 5/732

(58) Field of Search ..... 5/95, 630, 632, 5/424, 425, 426, 427, 428, 732, 655, 657, 657.5, 946, 640, 490

(56) References Cited

U.S. PATENT DOCUMENTS 1,701,124 A * 2/1929 Safford ..... 5/640
4,074,373 A * 2/1978 Garofalo ..... 5/640
4,607,402 A * 8/1986 Pollard ..... 5/425
4,873,734 A * 10/1989 Pollard ..... 5/425
5,148,564 A * 9/1992 Reder ..... 5/490
5,359,739 A * 11/1994 Rains et al. ..... 5/632
5,450,640 A * 9/1995 Patton et al. ..... 5/655
5,528,785 A * 6/1996 Petrus ..... 5/427

* cited by examiner

*Primary Examiner*—Michael F. Trettel
(74) *Attorney, Agent, or Firm*—Stout, Uxa, Buyan & Mullins, LLP; Greg S. Hollrigel

(57) ABSTRACT

The Snug Tuck Pillow includes a long tubular pillow, a removable fabric cover, a long elastic strap, with male and female Velcro, and a buckle to receive the elastic strap. The pillow is inserted into a fabric cover opening and closed using Velcro strips. The pillow is then placed on the side of the top mattress. The pillow is then secured by running the long elastic strap under the top mattress and through the buckle at the other end of the pillow. The elastic is then pulled tight until the two Velcro strips on the elastic strap meet and are married. This holds the pillow firmly in place.

20 Claims, 1 Drawing Sheet

SAFETY PILLOW TO PREVENT A PERSON FROM FALLING OFF A BED

A six-foot long, six inch diameter, tubular safety pillow, the purpose of which is to keep a child from falling or rolling off a bed while sleeping. Safety pillow has a removable, washable fabric cover, a buckle, and an elastic strap for securing.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates generally to a child security railing for small children at sleep in a bed. The present invention prevents a child from falling or rolling off the bed while sleeping.

2. Discussion of the Prior Art

Keeping a child safe in bed while sleeping is important to all parents. After being in a safe, secure crib for about the first two years, babies develop no fear of falling or rolling off while they sleep. When it's time to move to an adult bed, this becomes a problem. Toddlers continue to sleep restlessly breaking free from tucked in covers and end up falling off the side of the bed.

When my son made the transition from the crib to the bed, he had this same problem. I didn't want to buy a child's bed that looked like a racecar, for example, because I didn't want my son sleeping so close to the floor. These beds, although fun, also don't offer proper support for little backs and bodies. I wanted to put him into an adult bed to avoid the extra costs of a specialty child's bed, and to keep him safe at the same time. First, I put the bed against the wall to eliminate one side from which he could fall. I also stacked pillows around him and beside the bed to form a soft barrier, but they did not stay in place. He was still falling off the bed several times per night. There was also a chance that he could suffocate.

I then started to roll up his comforter and tuck it in at the top and the foot of the bed. This worked better, but still wasn't secure enough to keep him from kicking it free. That's when the idea first came to me for the Snug Tuck Pillow. The way to secure it came in the months that followed.

When a child falls from their bed while sleeping, several things happen. They can sustain an injury, become disoriented, scared, cry, and/or disturb the sleeping parents. Children become uneasy about going to bed and resist, if they are worried that they will fall out.

Some parents need or prefer to bring their babies into bed with them. Most of the time, they place the baby in the middle of the bed so there is less chance of them falling off the side. But, when mom and dad fall back asleep, there is the chance of the baby being injured, smothered or bumped by the sleeping parents.

When parents go to visit family or friends, they need to bring a portable crib, or something that they can lay the baby in to sleep. These cribs are heavy, time consuming to assemble, and require a great deal of space. They have also been found to be unsafe in some cases.

The security rails on bunk beds and child security beds are another area that can be inconvenient, uncomfortable, and even dangerous. Most often the railings on these security beds only protect the top half of the bed, and the child can still fall from the lower half. Most parents stack pillows beside them to make it more comfortable and safe for the child. If the child wakes up at night, they must call for help in order to get out of bed and use the restroom. Hinges on these railings can also be a source of injury.

BRIEF SUMMARY OF THE INVENTION

This is a simple invention to keep a child from rolling or falling off of the bed while sleeping. It is not a restraint of any kind. Its main function is to keep toddlers who are moving from the crib to an unconfined bed, from rolling or falling off of the side of the bed. It helps a child feel more secure about going to bed, and they will resist much less when it's bedtime. They will feel safer, more secure, and comfortable with the Snug Tuck Pillow.

If the bed has been placed in the middle of the room, or to protect the child from the cold, hard wall, the Snug Tuck Pillow may be placed on both sides. It is placed outside the covers, and will aid in keeping the covers tucked in on cold nights. The elastic strap is adjustable, so that it can also be placed under the covers, or on different size beds and couches.

Other uses include eliminating the need of a portable crib when the family is traveling, or visiting friends and relatives. Simply strap the Snug Tuck Pillow to a bed or couch and the baby is ready to lie down. It won't take up any extra room, and there is no hassle setting it up or taking it down.

When the parents choose to bring their baby or child into bed with them, simply secure the pillow to the side of the bed and place the baby or child next to it. The baby cannot fall off the side, and there is less chance of the baby being squashed, smothered or bumped by the sleeping parents.

Railings can be difficult to operate and dangerous to children. Railings are hard, and children hit their arms and legs while tossing and turning while sleeping, and can become wedged in between the railing and the bed, possibly causing injury. The Snug Tuck Pillow solves these problems and more. The child is also not being restrained, and can get out of bed without any assistance to use the restroom.

DETAILED DESCRIPTION OF THE INVENTION

Figure 1:
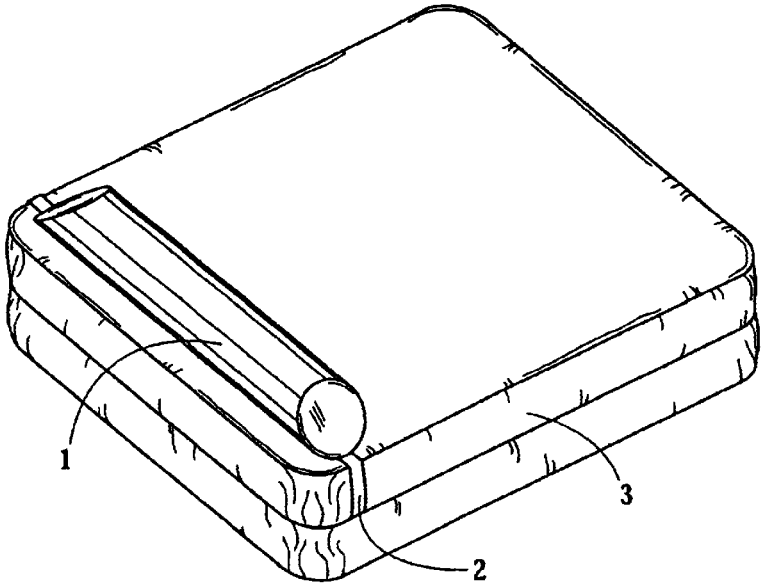
FIG. 1 is a view of the pillow attached to the side of the top mattress.

With reference now to the drawings, and particularly to FIG. 1, the pillow 1 is shown secured to the top mattress of a bed 3. The pillow includes a pillow 1, a fitted removable fabric cover 1, a securing strap 2, and a buckle to receive the securing strap. The pillow 1 may be fabricated out of foam, cotton, a synthetic blend or any material that is of a suitable firmness. The pillow cover is made from a durable washable fabric with any suitable fastening method, such as, sewing, fusing, or cement.

Figure 2:
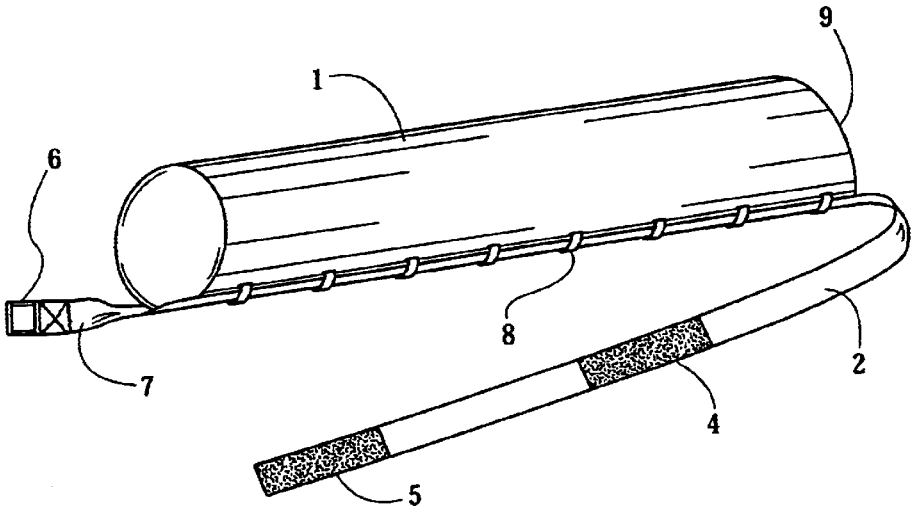
FIG. 2 shows the pillow alone so that one can see all the components.

Now with reference to FIG. 2, the securing strap 2 is attached to one end of the pillow cover using any suitable fastening method, such as, sewing, fusing, or cement. The securing strap 2 can be made from elastic, canvas, or any suitable strap material. The securing strap 2 is made securable by placing hook and loop fastener material, such as VELCRO, strips 4 and 5 in the appropriate places so that they marry the strap to itself. This and the weight of the top mattress keep this marriage of the hook and loop fastener material secure. A buckle 6, loop or any other suitable receiver is attached to the other end of the pillow cover, to receive the securing strap. The receiver 6 must allow the securing strap to be looped through and pulled tight. Thus, it must be of the appropriate strength to hold the securing strap tension. The securing strap receiver is attached to the pillow cover with any suitable fastening method, such as sewing, fusing, or cement. Each end of the pillow has a 45° angle taper 9.

The pillow is made securable by attaching a female hook and loop fastener strip 4 at the mid-section of the securing strap 2, and a male hook and loop fastener strip 5 on the same side at the end of the strap. The hook and loop fastener strips are attached with any suitable fastening method, such as, sewing, fusing, or cement.

The pillow cover 1 is closed using hook and loop fastener strips 8, buttons, or any other method of closing the cover flap allowing the pillow to be easily removed from the cover. The hook and loop fastener strips 8 are attached with any suitable fastening method such as, sewing, fusing, or cement. Hook and loop fastener material is the preferred choice because there is no choking hazard.

The pillow 1 is easily attached to the top mattress 3 by first placing the pillow along the side of the bed. The securing strap 2 is then placed under the top mattress 3 and through the strap receiver 6 at the other end of the pillow. The strap 2 is then pulled tight until the male and female 4&5 hook and loop fastener material meet under the top mattress 3. The pillow 1 is now secure. To remove the pillow 1, simply pull the hook and loop fastener strips 4 and 5 apart to release the securing strap 2.

While particular embodiments of the invention have been shown and described, it will be obvious to those in the field that changes and modifications may be made without departing from the invention in its broader aspects, and therefore, the aim in the appended claims is to cover all such changes and modifications as fall within the true spirit and scope of the invention.

I claim:

1. A safety pillow for preventing a person from falling off a bed, comprising:

an elongate body having a first end, a second end, a width, and a length extending from the first end to the second end, the length being substantially equal to a length of a mattress of a bed; and a strap assembly extending from the first end and the second end, the strap assembly being dimensioned to wrap around a mattress of a bed and to secure the elongate body over the mattress.

2. The pillow of claim 1, wherein the elongate body includes an end having a surface oriented at a non-perpendicular angle with respect to a top surface of the mattress of the bed.

3. The pillow of claim 2, wherein the first end and the second end of the elongate body include a surface oriented at a non-perpendicular angle.

4. The pillow of claim 1, wherein the elongate body includes a removable cover.

5. The pillow of claim 1, wherein the elongate body has a substantially circular cross-section.

6. The pillow of claim 1, wherein the elongate body comprises a material selected from the group consisting of foam, cotton, and a synthetic blend.

7. The pillow of claim 1, wherein the strap assembly comprises a first strap, a second strap, and a fastener material effective to secure the first strap to the second strap.

8. The pillow of claim 7, wherein the fastener material comprises a hook and loop fastener material.

9. The pillow of claim 7, wherein the fastener material is provided only on the first strap.

10. The pillow of claim 9, wherein the first strap comprises a plurality of strips of fastener material.

11. The pillow of claim 9, further comprising a strap receiver located on the second strap, the strap receiver being dimensioned to accommodate the first strap.

12. The pillow of claim 11, wherein the strap receiver is a buckle.

13. A safety pillow for a bed, comprising an elongate tubular body having a first end, a second end, a length extending from the first end to the second end, and a width having a dimension less than the length; and a strap assembly extending from the first end and the second end of the elongate tubular body, the strap being dimensioned to wrap around a mattress of a bed and to secure the elongate body over the mattress, and the strap assembly having a width less than the width of the elongate tubular body.

14. The pillow of claim 13, wherein the elongate tubular body includes an end having a surface oriented at an acute angle relative to the strap assembly.

15. The pillow of claim 13, wherein the elongate tubular body comprises a removable cover disposed around a core having a firmness of a pillow.

16. The pillow of claim 15, wherein the cover comprises a fastener to secure the cover around the core.

17. The pillow of claim 15, wherein the core comprises a material selected from a group consisting of foam, cotton, or a synthetic blend.

18. The pillow of claim 13, wherein the strap assembly comprises a single strap having a first end extending from the first end of the elongate body, and a second extend extending from the second end of the elongate body.

19. The pillow of claim 13, wherein the first end of the strap includes a strap receiver structured to receive the second end of the strap.

20. The pillow of claim 19, wherein the second end of the strap includes a plurality of strips of hook and loop fastener material.

* * * * *